United States Patent [19]

Feibelman

[11] Patent Number: 4,997,153

[45] Date of Patent: Mar. 5, 1991

[54] COMBINATION HOLDER FOR AN ORNAMENTAL ARTICLE AND PROTECTOR THEREFOR

[75] Inventor: Jeffrey A. Feibelman, East Greenwich, R.I.

[73] Assignee: Display Technologies, Inc., Johnston, R.I.

[21] Appl. No.: 425,934

[22] Filed: Oct. 24, 1989

[51] Int. Cl.[5] ..... B65D 73/00

[52] U.S. Cl. ..... 248/214; 206/461

[58] Field of Search ..... 248/214; 206/461, 464, 206/467, 468, 486

[56] References Cited

U.S. PATENT DOCUMENTS

| | | | |
|---|---|---|---|
| 3,157,280 | 11/1964 | Perdue et al. | 206/468 |
| 3,382,972 | 5/1968 | Phipps | 206/468 |
| 4,175,666 | 11/1979 | Feibelman | 206/461 X |
| 4,284,981 | 8/1981 | Black | 248/214 X |
| 4,332,320 | 6/1982 | Feibelman | 206/404 X |
| 4,718,554 | 1/1988 | Barbato | 206/486 X |

FOREIGN PATENT DOCUMENTS

| | | | |
|---|---|---|---|
| 1952532 | 5/1971 | Fed. Rep. of Germany | 206/461 |
| 2536465 | 2/1977 | Fed. Rep. of Germany | 206/461 |

*Primary Examiner*—Alvin C. Chin-Shue

*Attorney, Agent, or Firm*—Salter & Michaelson

[57] ABSTRACT

A combination holder for an ornamental article and protector therefor is disclosed and includes a substantially flat card member on which the ornamental article is mounted. A cover member having a dish-like configuration receives the card member therein, the cover member having a front wall that is located in spaced relation with respect to the front surface of the card member when it is mounted on the holder so that the ornamental article as mounted on the card member is protected by the cover member during shipment and/or display of the card member and the ornamental article.

1 Claim, 1 Drawing Sheet

COMBINATION HOLDER FOR AN ORNAMENTAL ARTICLE AND PROTECTOR THEREFOR

BACKGROUND OF THE INVENTION

The present invention relates to the use of a conventional jewelry card on which an ornamental article is mounted, the jewelry card being employed in combination with a cover member that provides for the protection of the ornamental article as mounted on said card member during the shipment and/or display thereof.

It is conventional in the display of ornamental articles such as jewelry items, including earrings, pins and the like to mount the article on a card that is provided with a hook-like portion located on the upper end of the rear surface of the card. The hook-like portion enables the card to be received on a horizontal rod that forms a part of a display rack, the cards with the jewelry articles mounted thereon thereby being readily viewable by a customer for visual inspection of the ornamental article.

When a fragile article is utilized as part of the jewelry article and is mounted on the jewelry card, problems have been experienced, particularly in the shipment of the carded jewelry from the manufacturer of the jewelry to the customer. Usually carded jewelry articles are indiscriminately placed in cartons and are shipped to the customer in bulk form, primarily because of the labor costs that are involved in packing the jewelry articles in boxes in a more secure manner. In many instances jewelry articles are not subject to bending, chipping or breaking in shipment, but oftentimes jewelry articles such as those made of fragile materials such as porcelain can be damaged in shipment when packaged in bulk form and as a result these kinds of articles as mounted on cards must be packaged separately for protection against chipping, cracking and general breakage. Prior to the instant invention, generally there have not been any unusual precautions taken for separately packaging such fragile jewelry articles when they are shipped in the usual fashion, that is, in boxes that contain a number of the articles that are indiscriminately placed within the package. Although some efforts have been made heretofore to specifically protect the more fragile articles, it is understood that providing for separate wrapping in the cartons in which the fragile carded jewelry articles are packaged, does materially increase the cost of the articles.

As will be described hereinafter, the present invention provides a simple yet effective protector for fragile ornamental articles, wherein the jewelry and card on which it is mounted is packaged in the usual manner in bulk form within a carton without materially increasing the cost of the ornamental article yet providing for complete protection therefor against breaking and chipping.

SUMMARY OF THE INVENTION

The present invention relates to a combination holder for an ornamental article and a protector therefor and comprises a substantially flat card member on which the ornamental article is mounted. A transparent cover member is provided having a dish-like configuration defined by a front wall to which are joined shortened walls that extend outwardly therefrom. Each of the shortened walls has a outwardly extending portion joined thereto in offset relation to form a shoulder, the shoulders as formed on said portion receiving peripheral portions of said card member thereon so as to locate said card member in spaced parallel relation with respect to the front wall. Means are further joined to the outwardly extending portions for releasably retaining the card member in place on the shoulders of the cover member, wherein the cover member defines a protective cover for the ornamental article as mounted on the card member in the shipment and/or display thereof.

The card member may also be provided with a hook portion that is joined to the upper edge thereof and defines means for mounting the card member on a display rod that defines an element of a display rack; and the retaining means for locating the card member in place on the cover member being defined by a plurality of tabs that overlie the card member so as to secure the card member in place on the cover member.

Accordingly, it is an object of the present invention to provide a combination holder for an ornamental article and protector that includes a substantially flat card member on which the ornamental article is mounted, the card member being releasably mounted on a transparent cover member having a dish-like configuration and including a front wall that is spaced from the card member and the ornamental article thereon so as to provide a protector for the ornamental article during shipment and/or display thereof.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE PREFERRED EMBODIMENT

Figure 1:
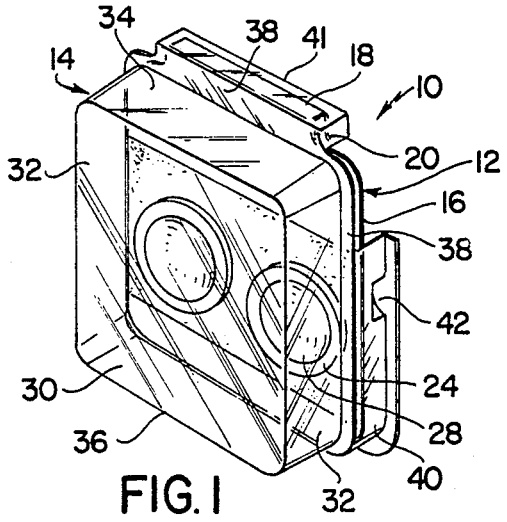
FIG. 1 is a perspective view of the combination holder for an ornamental article and protector therefor.
Figure 2:
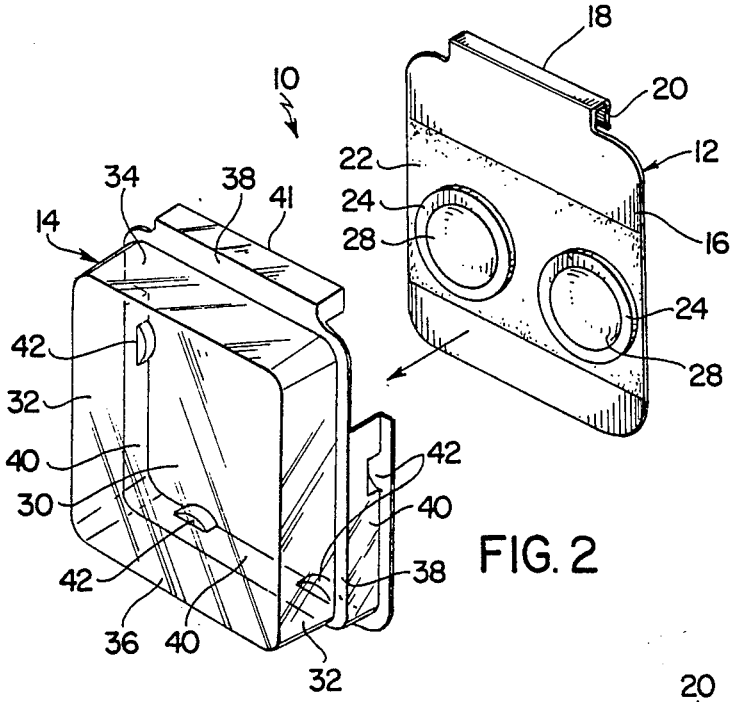
FIG. 2 is an exploded perspective view of the combination holder and protector as shown in FIG. 1.

Referring now to the drawing and particularly to FIGS. 1 and 2 therein, the combination holder and protector is illustrated and is generally indicated at 10. As more clearly shown in FIG. 2, the combination holder and protector includes a card member generally indicated at 12 and a cover member generally indicated at 14, the interrelation of which will be described in detail hereinafter.

Figure 3:
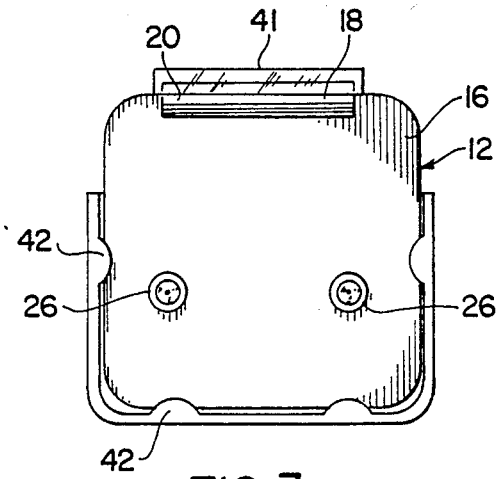
FIG. 3 is a rear elevational view thereof.

The card member 12 is of a conventional style that is well known in the jewelry industry and includes a flat body portion 16 formed of a plastic material. Formed on the topmost end of the body portion 16 is a rearwardly extending hook portion 18 to which a downwardly extending hook element 20 is joined that extends generally parallel to the card 16 and that is designed to be received over a horizontal rod for mounting the card member 12 thereon. As is conventional in card members of this type, a flocked portion such as simulated velvet is usually mounted on the face of the card as indicated at 22, jewelry articles such as earrings 24 being mounted on the flocked portion 22. For this purpose, small openings are usually formed in the flocked portion 22 in spaced relation, conventional earring posts that are attached to the earring members 24 extending through the openings and being locked in place on the rear side of the card 16 by posts 26 as illustrated in FIG. 3.

As shown in FIG. 2 the earring members 24 include fragile ornamental portions 28 which are formed of a fragile material such as porcelain. Oftentimes in the transport or shipment of the jewelry cards 12 with the earring members 24 mounted thereon, chipping or cracking of the ornamental fragile portions 28 thereof will occur unless the cards are wrapped or packaged in a way that will protect the fragile portions 28. However, it has been the usual custom in the packaging of carded jewelry articles to locate the carded jewelry articles in bulk form in a carton without any specific regard to the manner of placement, and therefore the articles are normally subject to a certain amount of movement as the packages are handled during shipment.

In order to prevent the cracking or chipping of the ornamental fragile portion 28 as shipped in loose bulk quantities in shipping cartons, the protective cover member 14 is provided. As shown in FIG. 2, the protective cover member 14 includes a front wall 30 to which sidewalls 32 are joined. Joined to the sidewalls 32 are the top and bottom walls 34 and 36, respectively. Extending rearwardly of the walls 32, 34 and 36 is a continuous flange 38 to which a shortened wall portion 40 is joined that extends in parallel but offset relation with respect to the sidewalls 32 and top and bottom walls 34 and 36 of the cover member 14. As shown more clearly in FIG. 3, the shortened wall portion 40 is cut-away adjacent to the upper portion of the cover member to expose the adjacent portions of the body portion 16 of the card member 12, when the card member is assembled on the cover member. The cut-away portions of the shortened wall portion 40, as will be described, enable the card member 12 as fixed on the cover member 14 to be mounted in position on a display rack. As further shown in FIGS. 2 and 3 the cut-away portions of the shortened wall portion 40 cause a top wall portion 41 to be formed that overlies the hook portion 18 when the card member 12 is assembled on the cover member 14.

In order to receive the card member 12 in the assembled position on the cover member 14 as shown in FIG. 1, a plurality of tabs 42 are provided and are joined to the interior surface of the shortened portion wall 40 at the outermost edges thereof, the tabs 42 being located in overlying spaced relation with respect to the continuous flange 38. The shortened wall portion 40 as formed on the cover member 14 and the continuous flange 38 that is joined thereto have a configuration that substantially corresponds to the peripheral edges of the card member 12. Thus, the card member 12 is received on the flange 38 by snapping it over the tabs 42 to seat it on the flange 38. The material from which the cover member is formed is preferably a clear plastic and is somewhat flexible so as to enable the card member 12 to be easily snapped over the tabs 42 for seating on the flange 38. The hook portion 18 of the card member 12 in the assembled position lies directly under the top wall portion 41 of the cover member, the hook element 20 of the hook portion 18 depending therebelow but being exposed as a result of the cut-away portions of the shortened wall portions 40. The location of the hook portion 18 and the hook element 20 as formed as a part thereof is shown more clearly in FIG. 3 in the assembled position of the card member 12 on the cover member 14.

In use of the device and with the card member 12 assembled on the cover member 14 and resting on the flange 38, the tabs 42 are located in overlying relating with respect to the adjacent peripheral portion of the card member and secure the card member 12 on the flange 38 so as to prevent the inadvertent removable therefrom. Because of the flexibility of the material from which the cover member 14 is formed, the card member may be easily removed therefrom as required. With the card member 12 and the jewelry articles 24 located thereon mounted in place on the cover member 14, it is seen that the transparent front wall 30 enables the jewelry articles 24 to be clearly visible. In the assembled position, the card member 12 and cover member 14 may be packaged in bulk form with other similarly assembled combination devices or with other card members 12 on which jewelry articles are mounted. When it is desired to locate only the card members 12 on a conventional jewelry rack on which are mounted horizontal rods, the card member 12 is removed from the cover member 14 and suspended on a horizontal rod by means of the hook portion 18 engaging the horizontal rod in the conventional manner. However, if it is still desirable to protect the fragile ornamental portion of the jewelry article as mounted on the card member 12, the assembled card member 12 and cover member 14 may be mounted on the horizontal rod by means of the exposed hook portion 18. This, it is seen that the cut-away portions of the shortened walls 40 enable the horizontal rod on which the hook portion 18 is mounted to extend therethrough for easily locating the hook portion 18 of the card member 12 on the rod to mount the assembly in the suspended position.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A combination holder for an ornamental article and protector therefor, comprising a substantially flat card member having an ornamental front surface on which said ornamental article is mounted and a rearwardly extending hook portion on said card member for hanging said card member on a display rod, a transparent cover member having a dish-like configuration defined by a front wall to which sidewalls and a top and bottom wall are joined, a continuous flange joined to said top, bottom and sidewalls and located rearwardly thereof, a shortened wall portion joined to said continuous flange, said shortened wall portion terminating in a rear peripheral edge and being located in offset and parallel relation with respect to said sidewalls and top and bottom walls, said continuous flange being spaced inwardly of the rear peripheral edge of said shortened wall portion and defining a continuous inwardly located shoulder, said shoulder receiving peripheral portions of said card member thereon so as to locate said card member and said hook portion wholly within the confines of said shortened wall portion and in spaced parallel relation with respect to said front wall thereof, a plurality of spaced tabs joined to said shortened wall portion adjacent to the rear peripheral edge thereof and overlying peripheral portions of said card member and over which said card member is snapped when the card member is moved to a mounted position on said shoulder, said card member being formed of a flexible plastic material that enables it to be snap fitted over said tabs for being received on said shoulder, wherein said cover member defines a protective cover for the ornamental article as mounted on said card member during shipment and/or display thereof, said shortened wall portion having at least one opening formed therein adjacent said hook portion permitting passage of a display rod through said opening for hanging said card member from said display rod with said hook portion when said cover member is received on said card member.

* * * * *